US006692583B2

(12) United States Patent
Bengston et al.

(10) Patent No.: US 6,692,583 B2
(45) Date of Patent: Feb. 17, 2004

(54) MAGNESIUM CONVERSION COATING COMPOSITION AND METHOD OF USING SAME

(76) Inventors: Jon Bengston, 70 Bonny View Rd., West Hartford, CT (US) 06107; Mark Wojtaszek, 23 Cricket La., Burlington, CT (US) 06013; Gerald Wojcik, 330 Atwood Rd., Thomaston, CT (US) 06787; Massimo Dimarco, 737 South St., Middlebury, CT (US) 06762

( * ) Notice: Subject to any disclaimer, the term of this patent is extended or adjusted under 35 U.S.C. 154(b) by 105 days.

(21) Appl. No.: 10/076,897

(22) Filed: Feb. 14, 2002

(65) Prior Publication Data

US 2003/0150526 A1 Aug. 14, 2003

(51) Int. Cl.[7] ..... C23C 22/07

(52) U.S. Cl. ..... 148/261; 148/273; 148/275; 106/14.12

(58) Field of Search ..... 148/261, 273, 148/275; 106/14.12

(56) References Cited

U.S. PATENT DOCUMENTS

| | | | | |
|---|---|---|---|---|
| 4,873,011 | A | * 10/1989 | Jung et al. | 252/75 |
| 5,037,478 | A | 8/1991 | Okai et al. | |
| 5,520,750 | A | 5/1996 | Riley | |
| 5,968,240 | A | 10/1999 | Myers et al. | |
| 5,993,567 | A | 11/1999 | Dolan | |
| 6,027,579 | A | 2/2000 | Das et al. | |

* cited by examiner

*Primary Examiner*—John Sheehan
*Assistant Examiner*—Andrew L. Oltmans
(74) *Attorney, Agent, or Firm*—Carmody & Torrance LLP

(57) ABSTRACT

A conversion coating composition and a method of applying the conversion coating composition to magnesium and magnesium alloy articles prior to painting to prevent corrosion. The conversion coating composition comprises a source of vanadate ions, a material comprising phosphorus, and nitric acid or a source of nitrate ions. In addition, the composition may also contain boric acid or a source of borate ions and a source of fluoride ions or a source of fluoroborate ions.

57 Claims, No Drawings

MAGNESIUM CONVERSION COATING COMPOSITION AND METHOD OF USING SAME

FIELD OF THE INVENTION

This invention relates to a conversion coating composition for magnesium and magnesium alloy articles that achieves similar results to a chromate conversion coating, without the hazardous effects of chromium. In addition, the invention relates to a method of applying the conversion coating composition to magnesium and magnesium alloy articles before painting to prevent corrosion.

BACKGROUND OF THE INVENTION

The invention relates to a conversion coating for preparing magnesium and magnesium alloy parts prior to painting. Paint adhesion to magnesium and magnesium alloy substrates is poor if the substrate are not first coated with a conversion coating. Paint does not bond well to the natural oxide of magnesium, and the rapid oxidation of magnesium makes it impractical to clean and deoxidize the surface of the article prior to painting. Consequently, painted magnesium that is commercially manufactured is coated with a conversion coating prior to painting.

Several methods are commonly used as conversion coatings to prepare magnesium and magnesium alloy articles prior to painting, including chrome bearing conversion coatings and electrolytic anodizing. Both chrome bearing conversion coatings and electrolytic anodizing are well known in the art and have been the subject of numerous patents.

Painted magnesium parts are also susceptible to peeling in corrosive environments. Corrosion proceeds laterally under the surface of the painted magnesium, typically starting at a scratched area, until the paint either forms a blister or peels away. Coating with a corrosion inhibitor before painting prevents the paint from peeling.

The conversion coating of the present invention, provides an adherent and corrosion resistant base on magnesium and magnesium alloy substrates in preparation for painting.

The composition of the present invention achieves similar or better results than chromate conversion coatings without the use of chromium. Chromium is extremely toxic even at low levels and is an increasingly regulated material. It is therefore beneficial to use a product that does not contain chromium. In addition, the method of the present invention is an immersion process, so racking and external power, such as is necessary in anodizing operations, are not needed, providing a cost and product efficiency benefit over anodizing.

SUMMARY OF THE INVENTION

The inventors herein have discovered a novel composition and method for creating a conversion coating on magnesium. The invention comprises contacting magnesium or magnesium alloy with a composition comprising:

1) A source of vanadate ions;
2) A material comprising phosphorus selected from the group consisting of sources of phosphite ions, sources of hypophosphite ions, sources of phosphate ions, sources of phosphorus ions, sources of hypophosphorus ions, and combinations of the foregoing;
3) Nitric acid or a source of nitrate ions;
4) Optionally, but preferably, boric acid or a source of borate ions; and
5) Optionally, but preferably, a source of fluoride ions or fluoroborate ions.

DETAILED DESCRIPTION OF THE INVENTION

The composition for use in the process of the present invention creates a unique conversion coating on magnesium and/or magnesium alloys. This conversion coating inhibits the subsequent corrosion of the treated surfaces and increases the adhesion of subsequent coatings such as paints, lacquers, and other such finishes to the treated surfaces. These and other advantages can be achieved by treating the surfaces of magnesium or magnesium alloys with a composition comprising:

1) A source of vanadate ions;
2) A material comprising phosphorus selected from the group consisting of sources of phosphite ions, sources of hypophosphite ions, sources of phosphate ions, sources of phosphorus ions, sources of hypophosphorus ions, and combinations of the foregoing;
3) Nitric acid or a source of nitrate ions;
4) Optionally, but preferably, boric acid or a source of borate ions; and
5) Optionally, but preferably, a source of fluoride ions or fluoroborate ions.

Vanadate is added to the composition as any corresponding soluble salt or acid of vanadium. Some examples include sodium vanadate, potassium vanadate, and ammonium vanadate. Ammonium vanadate is preferred, preferably at a concentration of about 5 grams/liter. The concentration of vanadate in the mixture should preferably be in the range of 0.1 to 5 grams per liter, where the upper concentration is limited by the solubility of the vanadate in the mixture.

The concentrate of nitric acid or nitrate ions in the solution may range from 1 g/l to near saturation but preferably is from about 25 g/l to about 200 g/l. If nitric acid is used, then it must be neutralized so that the pH of the solution preferably ranges from about 1 to about 4. Neutralization is preferably carried out with ammonium hydroxide. In the alternative, sources of nitrate such as sodium nitrate, potassium nitrate, or ammonium nitrate may be utilized with ammonium nitrate being preferred.

The phosphorus comprising material can be any of a variety of phosphorus comprising materials including hypophosphorus acid, phosphorus acid, sodium (or potassium or ammonium) phosphite, sodium (or potassium or ammonium) orthophosphite, sodium (or potassium or ammonium) hypophosphite, and phosphoric acid or salts thereof. The concentration of the phosphorus comprising material in the composition should preferably range from about 10 g/l to about 200 g/l and is preferably about 100 g/l.

One source of the phosphorus acid, orthophosphite, and/or hypophosphite is spent electroless nickel solutions. Spent electroless nickel baths may contain up to 250 grams/liter of phosphorus acid salts. The spent electroless nickel baths are normally waste treated or hauled away at some expense when the concentration of phosphorus acid salts in the baths reaches an unacceptable level. Using spent electroless nickel solutions provides a benefit to electroless nickel users by removing waste chemicals at minimal cost, as well as providing a benefit to manufacturers of the present invention by providing a raw material source at little or no cost. Preferably, the nickel ions in the spent electroless nickel solution have been removed by plating or other precipitation methods.

The conversion coating composition, optionally but preferably, also comprises a source of borate ions, fluoride ions, and/or fluoroborate ions. Most preferably, the composition comprises a source of fluoroborate ions such as sodium tetrafluoroborate or ammonium fluoroborate. Sources of borate ions include boric acid and salts thereof. Sources of fluoride include sodium fluoride, potassium fluoride, and ammonium fluoride. Preferably the concentrations of borate ions, fluoride ions, and/or fluoroborate ions in the composition ranges from about 0.1 g/l to about 200 g/l and is most preferably about 10 g/l to about 30 g/l.

The inventors have also found that it is preferably beneficial to include one or more materials selected from the group consisting of hydrofluorosilicic acid, triethanolamine, and surfactants. If used, the concentration of hydrofluorosilicic acid should preferably range from about 0.1 g/l to about 100 g/l but is most preferably from about 0.5 g/l to about 5 g/l. The inventors have found that the inclusion of triethanolamine in the conversion coating composition assists with the cleaning of the treated surfaces and therefore assists with the formation and uniformity of the conversion coating. If used, the concentration of triethanolamine in the composition should preferably range from about 1 g/l to about 100 g/l and is most preferably from about 5 g/l to about 30 g/l. Lastly, the inventors have found that the inclusion of a surfactant in the conversion coating composition is useful. Fluoro-surfactants such as Dupont FSK or 3M FC-135 surfactants are most preferred. If used, the concentration of surfactant in the composition preferably ranges from about 0.1 g/l to about 4 g/l, and is most preferably about 1 g/l.

The pH of the solution should range from about 1 to about 4, with an optimal pH of 2. The operating temperature of the solution is generally between 40° F. and 140° F., with a preferred temperature of between 55° F. and 85° F.

EXAMPLE 1

A conversion coating composition is prepared by dissolving the following in water:

- 20 g/l triethanolamine
- 20 g/l sodium tetrafluoroborate
- 880 g/l spent de-nickeled (50 mg/l nickel) electroless nickel solution equivalent to 100 g/l of sodium orthophosphite
- 100 g/l nitric acid
- 20 g/l ammonium vanadate
- 5 g/l 20% fluorosilicic acid The pH of the solution is adjusted as required to 2. In addition, 50 grams/liter of ammonium hydroxide is added to the composition if phosphorus acid is used as the phosphorus containing material.

The composition is usable in a process for preparing magnesium and magnesium alloy parts for painting.

In order to prepare magnesium and magnesium alloy parts for painting, the parts are first cleaned in an alkaline cleaning solution, such as MacDermid 417 (available from MacDermid, Inc., of Waterbury, Conn.). The parts are immersed in the cleaning solution for a time period of one or more minutes. The operating temperature of the cleaning solution is between 45° F. and 212° F. For optimal cleaning, the parts are immersed in a cleaning solution heated to 180° F. for a period of 5 minutes. Preferably, the cleaning solution is also agitated. The alkaline cleaning solution prepares magnesium alloy arts by cleaning the parts. The cleaning step is important as it allows for consistent results, regardless of the magnesium alloy type or homogeneity of the magnesium.

Magnesium alloys are universally identified by the amount of aluminum and zinc present in the alloy. For example, AZ91 contains 9 percent aluminum and 1 percent zinc. The alkaline cleaning solution not only cleans the surface of the magnesium or magnesium alloy part, but also dissolves amphoteric metals such as zinc and aluminum. The resulting magnesium rich surface after treatment is preferable for conversion coating.

After cleaning, the magnesium parts are rinsed in water. The parts are then immersed in the composition of the invention for a period of 5 minutes. The operating temperature of the composition of the bath is generally 75° F., and agitation of the bath is not required.

The magnesium parts gas vigorously in the bath at first, and then, after about 30 seconds, the gassing slows. After 5 minutes, the parts have a dark, mostly uniform appearance. After the parts are removed from the solution bath, they are rinsed for a period of 5 minutes. Rinsing the parts for 5 minutes lightens the appearance of the parts and dissolves the surface smut in the rinse water, exposing a matte gray finish. The parts may then be dried and painted.

Painting the part requires no further preparation. The paint is applied by spraying, brushing, dipping, or any other suitable coating method. Obviously, care needs to be exercised to insure that the part is not contaminated between drying and painting.

EXAMPLE 2

Magnesium alloy parts (AZ91) containing 9% aluminum and 1% zinc are immersed in an alkaline cleaning bath comprising MacDermid 417 with a concentration of 20 percent by volume. 100 grams/liter of caustic is added to the bath to raise the total alkalinity of the cleaning bath, and thus enhance the de-alloying properties of the bath. The parts are soaked in the bath for 5 minutes at a bath temperature of 180° F. The parts are then rinsed in clean water at a temperature of 75° F. for a period of 15 seconds. Next, the parts are immersed in the composition described in Example 1 for a period of 5 minutes at a temperature of 75° F. The parts are rinsed in clean water with agitation for a period of 5 minutes and are then force air-dried. Finally, the parts are spray-painted using Rustoleum® or a similar product and then air-dried.

Paint adhesion is evaluated by a cross-hatch and tape test. The painted parts are cross-hatched (scratched in a cross-hatch pattern) to expose the magnesium surface and then placed into a salt spray for a period of 24 hours. After 24 hours of salt exposure, the parts are examined for corrosion and paint adhesion.

The adhesion of the paint is good even in areas adjacent to the exposed magnesium. White corrosion on the parts is limited to exposed magnesium prior to testing.

Unpainted parts that are salt spray tested showed no general corrosion after 24 hours of exposure. Casting gate areas, which generally have a high porosity, did show some white corrosion. However, these areas were isolated and limited.

Similar parts processed by electrolytic anodizing showed similar results and parts that were chromated showed slightly more white corrosion but had similar paint adhesion.

What is claimed is:

1. A magnesium conversion coating composition comprising:

a) a source of vanadate ions;

b) 10 to 200 grams/liter of a material comprising phosphorus; and c) a source of nitrate ions;

wherein the vanadate ions, phosphorus material, and nitrate ions are dissolved in an aqueous solution, and the pH of the composition is between 1 and 4.

2. A composition according to claim 1, wherein the source of vanadate ions is selected from the group consisting of sodium vanadate, potassium vanadate and ammonium vanadate.

3. A composition according to claim 1, wherein the composition contains 0.1 to 5 grams/liter vanadate ions.

4. A composition according to claim 3, wherein the composition contains 5 grams/liter vanadate ions.

5. A composition according to claim 1, wherein the material comprising phosphorus is selected from the group consisting of hypophosphorus acid, phosphorus acid, sodium phosphite, potassium phosphite, ammonium phosphite, sodium orthophosphite, potassium orthophosphite, ammonium orthophosphite, sodium hypophosphite, potassium hypophosphite, ammonium hypophosphite, phosphoric acid, and salts thereof.

6. A composition according to claim 1, where the composition contains 100 grams/liter of the material comprising phosphorus.

7. A composition according to claim 5, wherein the material comprising phosphorus is supplied from spent electroless nickel solutions containing up to 250 grams/liter of phosphoric acid salts.

8. A composition according to claim 1, wherein the source of nitrate ions is selected from the group consisting of nitric acid, sodium nitrate, potassium nitrate, and ammonium nitrate.

9. A composition according to claim 1, wherein the composition contains 25 to 200 grams/liter nitrate ions.

10. A composition according to claim 1, wherein the composition further comprises a source of borate ions, a source of fluoride ions, a source of fluoroborate ions, or any combination thereof.

11. A composition according to claim 10, wherein the composition comprises a source of fluoroborate ions selected from the group consisting of sodium tetrafluoroborate and ammonium fluoroborate.

12. A composition according to claim 10, wherein the composition contains 0.1 to 200 grams/liter of the source of borate ions, the source of fluoride ions, the source of fluoroborate ions, or combination thereof.

13. A composition according to claim 12, wherein the composition contains 10 to 30 grams/liter of the source of borate ions, the source of fluoride ions, the source of fluoroborate ions, or combination thereof.

14. A composition according to claim 1, wherein the composition further comprises 5 grams/liter hydrofluorosilicic acid.

15. A composition according to claim 1, wherein the composition further comprises 1 to 100 grams/liter triethanolamine.

16. A composition according to claim 15, wherein the composition comprises 20 grams/liter triethanolamine.

17. A composition according to claim 1, wherein the composition further comprises a surfactant.

18. A composition according to claim 1, wherein the pH of the composition is 2.

19. A method of applying a magnesium conversion coating to magnesium or magnesium alloy substrates comprising the steps of:

a) cleaning said magnesium or magnesium alloy substrates by immersing the substrates in an alkaline cleaning bath;

b) rinsing the cleaned substrates with water c) immersing said substrates in an aqueous conversion coating composition comprising a source of vanadate ions, a material comprising phosphate, and a source of nitrate ions, to form a conversion coating on a surface of said magnesium or magnesium alloy substrates; and d) rinsing said substrates with water for a period of 5 minutes to dissolve surface smut on said surface of said substrates.

20. A method according to claim 19, wherein the operating temperature of the alkaline cleaning bath is between 45 and 212° F., and the alkaline cleaning bath is agitated.

21. A method according to claim 20, wherein the operating temperature of the alkaline cleaning bath is 180° F. and the substrates are immersed in said bath for a period of 5 minutes.

22. A method according to claim 19, wherein aqueous conversion coating composition has an operating temperature between 40 and 140° F.

23. A method according to claim 22, wherein the aqueous conversion coating composition has an operating temperature of 75° F.

24. A method according to claim 19, wherein the substrates are immersed in the aqueous conversion coating composition for a period of 5 minutes.

25. A method according to claim 19, wherein the source of vanadate ions is selected from the group consisting of sodium vanadate, potassium vanadate, and ammonium vanadate.

26. A method according to claim 19, wherein the aqueous conversion coating composition contains 0.1 to 5 grams/liter vanadate ions.

27. A method according to claim 26, wherein the aqueous conversion coating composition comprises 5 grams/liter vanadate ions.

28. A method according to claim 19, wherein the material comprising phosphorus is selected from the group consisting of hypophosphorus acid, phosphorus acid, sodium phosphite, potassium phosphite, ammonium phosphite, sodium orthophosphite, potassium orthophosphite, ammonium orthophosphite, sodium hypophosphite, potassium hypophosphite, ammonium hypophosphite, phosphoric acid, and salts thereof.

29. A method according to claim 19, wherein the aqueous conversion coating composition contains 10 to 200 grams/liter of the material comprising phosphorus.

30. A method according to claim 29, wherein the aqueous conversion coating composition contains 100 grams/liter of the material comprising phosphorus.

31. A method according to claim 30, wherein the material comprising phosphorus is supplied from spent electroless nickel solutions containing up to 250 grams/liter of phosphoric acid salts.

32. A method according to claim 19, wherein the source of nitrate ions is selected from the group consisting of nitric acid, sodium nitrate, potassium nitrate, and ammonium nitrate.

33. A method according to claim 19, wherein the aqueous conversion coating composition contains 25 to 200 grams/liter nitrate ions.

34. A method according to claim 19, wherein the aqueous conversion coating composition further comprises a source of borate ions, a source of fluoride ions, a source of fluoroborate ions, or any combination thereof.

35. A method according to claim 34, wherein the aqueous conversion coating composition comprises a source of fluoroborate ions selected from the group consisting of sodium tetrafluoroborate and ammonium fluoroborate.

36. A method according to claim 34, wherein the aqueous conversion coating composition contains 0.1 to 200 grams/liter of the source of borate ions, the source of fluoride ions, the source of fluoroborate ions, or combination thereof.

37. A method according to claim 36, wherein the aqueous conversion coating composition contains 10 to 30 grams/liter of the source of borate ions, the source of fluoride ions, the source of fluoroborate ions, or combination thereof.

38. A method according to claim 19, wherein the aqueous conversion coating composition further comprises 5 grams/liter hydrofluorosilicic acid.

39. A method according to claim 19, wherein the aqueous conversion coating composition further comprises 1 to 100 grams/liter triethanolamine.

40. A method according to claim 38, wherein the aqueous conversion coating composition contains 20 grams/liter triethanolamine.

41. A method according to claim 19, wherein the aqueous conversion coating composition further comprises a surfactant.

42. A method according to claim 19, wherein the pH of the aqueous conversion coating composition is 2.

43. A method of applying a magnesium conversion coating to a magnesium or magnesium alloy substrate comprising immersing said substrate in an aqueous conversion coating composition comprising a source of vanadate ions, a material comprising phosphorous, and a source of nitrate ions, to form a conversion coating on a surface of said magnesium or magnesium alloy substrate.

44. A method according to claim 43, wherein aqueous conversion coating composition has an operating temperature between 40 and 140° F.

45. A method according to claim 43, wherein the substrates are immersed in the aqueous conversion coating composition for a period of 5 minutes.

46. A method according to claim 43, wherein the source of vanadate ions is selected from the group consisting of sodium vanadate, potassium vanadate, and ammonium vanadate.

47. A method according to claim 43, wherein the aqueous conversion coating composition contains 0.1 to 5 grams/liter vanadate ions.

48. A method according to claim 43, wherein the material comprising phosphorus is selected from the group consisting of hypophosphorus acid, phosphorus acid, sodium phosphite, potassium phosphite, ammonium phosphite, sodium orthophosphite, potassium orthophosphite, ammonium orthophosphite, sodium hypophosphite, potassium hypophosphite, ammonium hypophosphite, phosphoric acid, and salts thereof.

49. A method according to claim 43, wherein the aqueous conversion coating composition contains 10 to 200 grams/liter of the material comprising phosphorus.

50. A method according to claim 49, wherein the material comprising phosphorus is supplied from spent electroless nickel solutions containing up to 250 grams/liter of phosphoric acid salts.

51. A method according to claim 43, wherein the source of nitrate ions is selected from the group consisting of nitric acid, sodium nitrate, potassium nitrate, and ammonium nitrate.

52. A method according to claim 43, wherein the aqueous conversion coating composition contains 25 to 200 grams/liter nitrate ions.

53. A method according to claim 43, wherein the aqueous conversion coating composition further comprises a source of borate ions, a source of fluoride ions, a source of fluoroborate ions, or any combination thereof.

54. A method according to claim 53, wherein the aqueous conversion coating composition comprises a source of fluoroborate ions selected from the group consisting of sodium tetrafluoroborate and ammonium fluoroborate.

55. A method according to claim 43, wherein the aqueous conversion coating composition further comprises 5 grams/liter hydrofluorosilicic acid.

56. A method according to claim 43, wherein the aqueous conversion coating composition further comprises 1 to 100 grams/liter triethanolamine.

57. A method according to claim 43, wherein the aqueous conversion coating composition further comprises a surfactant.

* * * * *